US006868689B1

(12) United States Patent
McNeil et al.

(10) Patent No.: US 6,868,689 B1
(45) Date of Patent: Mar. 22, 2005

(54) CONDENSATE DRAIN PAN

(75) Inventors: Donald A. McNeil, Amherst, VA (US); James M. Wakefield, Gladstone, VA (US); James C. Land, Forest, VA (US)

(73) Assignee: Buffalo Air Handling Company, Amherst, VA (US)

( * ) Notice: Subject to any disclaimer, the term of this patent is extended or adjusted under 35 U.S.C. 154(b) by 1024 days.

(21) Appl. No.: 09/838,347

(22) Filed: Apr. 20, 2001

(51) Int. Cl.[7] ..... F25D 21/14
(52) U.S. Cl. ..... 62/285; 62/288
(58) Field of Search ..... 62/285, 288

(56) References Cited

U.S. PATENT DOCUMENTS 3,596,475 A * 8/1971 Berger ..... 62/285
3,678,993 A * 7/1972 Pierce ..... 165/76
3,805,404 A * 4/1974 Gould ..... 34/75
4,907,420 A * 3/1990 Mahanay et al. ..... 62/291
5,511,386 A * 4/1996 Russ et al. ..... 62/285
5,669,230 A * 9/1997 Bruce et al. ..... 62/285
5,901,566 A * 5/1999 Macosko et al. ..... 62/285
5,964,370 A * 10/1999 Rust, Jr. et al. ..... 220/571

* cited by examiner

*Primary Examiner*—William Doerrler
*Assistant Examiner*—Mark Shulman
(74) *Attorney, Agent, or Firm*—Vickers, Daniels & Young

(57) ABSTRACT

A condensate drain pan comprises a compound-sloped floor surface having intersecting sloped faces which slope from a high point to a low point. The intersecting sloped faces form creases therebetween to facilitate condensate elimination, and the floor surface includes condensate directing embossments which further facilitate condensate elimination. The condensate drains to a drain opening at the low point.

24 Claims, 2 Drawing Sheets

CONDENSATE DRAIN PAN

This invention relates generally to condensate drain pans for air handling units, and more specifically, to a compound-sloped condensate drain pan able to eliminate accumulations of water at the base of an air handling unit.

The invention is particularly applicable to and will be described with specific reference to draining condensate from air handling units. However, those skilled in the art will recognize that the invention may have broader applications and could be utilized in other areas where eliminating accumulation of fluids is desired.

BACKGROUND OF THE INVENTION

The air conditioning industry has come under heightened scrutiny to improve indoor air quality, particularly relating to health risks that have been identified as resulting from microbial and mold growth from standing condensate in air conditioning units. Typically, the standing condensate remains in the drain pans during and after the air conditioning unit's run cycle. This accumulation of condensate allows the microbial growth to occur and affects the resultant indoor air quality during subsequent run cycles. Primarily for this reason, the air conditioning industry has heightened its awareness regarding the maintenance and cleaning of heating, ventilation, and air conditioning (HVAC) units to eliminate the aforementioned problem.

Attempted solutions have involved a variety of drain pan configurations. Prior art drain pan configurations have involved multiple components and multiple connections in order to secure the drain pan to the HVAC unit and to encourage elimination of the condensate. Multiple components discharging condensation require multiple drain pans, thereby exasperating the problem that the drain pan is trying to resolve. Additionally, multiple components make the installation and fastening of the drain pan to the HVAC unit cumbersome. Also, for many of the existing drain pan configurations, the orientation of the drain pan with respect to the HVAC unit is critical. Furthermore, existing drain pan configurations require a precise leveling of the HVAC unit to ensure the condensate drips at a particular location, and subsequently drains to a defined location.

Existing drain pan configurations often contain a drain hole or drain plug. The drain hole or plug is conducive to not only microbial growth, but is also susceptible to eventual clogging of the opening. This, in turn, will result in overflow of the condensate drain pan as well as accumulation of condensate within the HVAC unit and to the surrounding space.

There are also other problems which commonly occur with condensate drain pans. The many different types of HVAC units involve different air flow volumes and different velocities because of the different blower settings, duct work, and size of the unit. A unit with a relatively high air flow may cause the condensate to blow out of the condensate drain pan if the water level is too high. In addition, depending on where the condensate drips onto the drain pan, some existing configurations may serve some types of HVAC units adequately, whereas the same drain pan configuration will be ineffective on another type of HVAC unit.

Many existing drain pan configurations have incorporated multiple drain outlets in an attempt to accommodate different HVAC units and different condensate draining situations. This approach not only results in one or more drain outlets not being used, but also results in an additional fixture by which condensate can accumulate resulting in microbial growth.

Another existing approach to maintaining the cleanliness of drain pans is by chemical treatment. This process involves periodically treating the accumulated condensate by using various chemicals which prohibit microbial growth. Typically, this process first involves cleaning the drain pan by removing the existing accumulated condensate and subsequently depositing chemicals such that future condensate is treated as it stagnates in the drain pan. This process not only involves a time-consuming step of cleaning the drain pan, but also involves the secondary step of periodically applying chemicals. This process also requires that the HVAC unit be maintained on a preventative maintenance program to ensure that timely chemical treatment of the standing condensate is completed. Additionally, the use of chemicals in this process also affects the indoor air quality due to the fact that the HVAC unit has an intake which consumes the surrounding chemically-altered air.

Thus, there has long been a need for a condensate drain pan which can be installed on a wide variety of HVAC units, which is effective in retrofit applications, which minimizes the need for cleaning, which facilitates condensate flow, and which is easily and inexpensively manufactured.

SUMMARY OF THE INVENTION

In accordance with the present invention, a condensate drain pan is provided which addresses and overcomes or minimizes the foregoing and other problems of the prior art. More particularly in this respect, a drain pan in accordance with the invention is operable to funnel and discharge condensate, thus to minimize or eliminate microbial accumulation. By minimizing or eliminating microbial accumulation, periodic chemical treatment or cleaning of the drain pan is minimized. Likewise, monitoring and/or adjustment of the pan after initial installation is also minimized. Accordingly, maintenance time and effort is advantageously reduced. The drain pan is constructed from a single piece of sheet material or multiple pieces of material, preferably metal, which are constructed to eliminate the potential for leakage or condensate settling or accumulation during use while facilitating the ease of manufacture and reducing the cost thereof. Further, the drain pan is usable with a wide variety of types and sizes of air handling units as an original or replacement part, thus providing a versatility not available with drain pans provided heretofore.

Preferably, the condensate drain pan comprises a compound-sloped floor surface bounded by side walls and having at least one high point and at least one low point. The floor surface includes several intersecting sloped faces with varying slope directions and varying slope angles. The condensate drain pan also includes a drain opening which is proximal to the low point of at least one of the sloped faces and, preferably, further includes an embossed surface integral to at least one of the sloped faces which facilitates draining of the condensate and also provides structural strength. The drain pan is constructed such that the sloped faces are peripheral to the side walls of the pan and the sloped faces intersect to form creases which slope from a high point to a low point in the pan. The low point of at least one of the creases is proximal to the drain opening. Preferably, the sloped faces contain a combination of straight and V-shaped embossments to facilitate and promote condensate drainage as well as to provide structural strength. The sloped faces, creases, and embossments advantageously provide multiple points of condensate deflection and multiple angles of drainage which direct, channel, and accelerate condensate flow toward the drain opening therefore.

The present invention additionally provides a method of manufacturing a condensate drain pan. More particularly, the method of manufacture comprises the steps of pressing or stamping a condensate drain pan from a sheet(s) of metal or plastic to have a compound-sloped floor surface having sloped faces intersecting to provide creases therebetween which extend from a high point to a low point at which a condensate outlet is provided. Preferably, the method includes forming a pattern of straight-line and/or V-shaped embossments integral with at least one of the sloped faces.

It is accordingly an outstanding object of the present invention to provide a condensate drain pan which can be used with a multitude of different types and sizes of air handling units having different volumes of condensate discharge and different configurations in which the condensate is discharged from the air handling unit and which increases the indoor air quality by decreasing microbial growth heretofore resulting from the accumulation of standing condensate.

A further object is the provision of a drain pan which minimizes or eliminates the opportunity for microbial accumulation. In addition, the present invention minimizes requirements for: periodic chemical treatment, periodic cleaning, subsequent monitoring, and adjustment after initial installation; thus reducing the time consumed on preventative maintenance for air handling units and associated drain pans.

Another object of the present invention is to provide a condensate drain pan which increases the flow rate of discharged condensate relative to drain pans heretofore available.

Still another object of the present invention is to provide a condensate drain pan that provides multiple points of condensate deflection and multiple angles of drainage which function to direct, channel, and accelerate the flow of condensate toward a drain opening therefore.

A further object of the present invention is to provide a condensate drain pan which is structured to promote condensate discharge and remove the potential for leaks and/or condensate settling or accumulation while facilitating the ease of manufacture and reducing the cost thereof and promoting the ease of installation and/or replacement of drain pans on existing air handling units.

Yet another further object of the present invention is to provide a condensate drain pan effective for retrofit applications and/or replacements with respect to existing air handling units.

BRIEF DESCRIPTION OF THE DRAWINGS

The foregoing and other objects of the present invention will in part be obvious and in part explained more fully hereinafter in conjunction with the description of a preferred embodiment of the invention shown in the accompanying drawings in which.

DETAILED DESCRIPTION OF A PREFERRED EMBODIMENT

Figure 1:
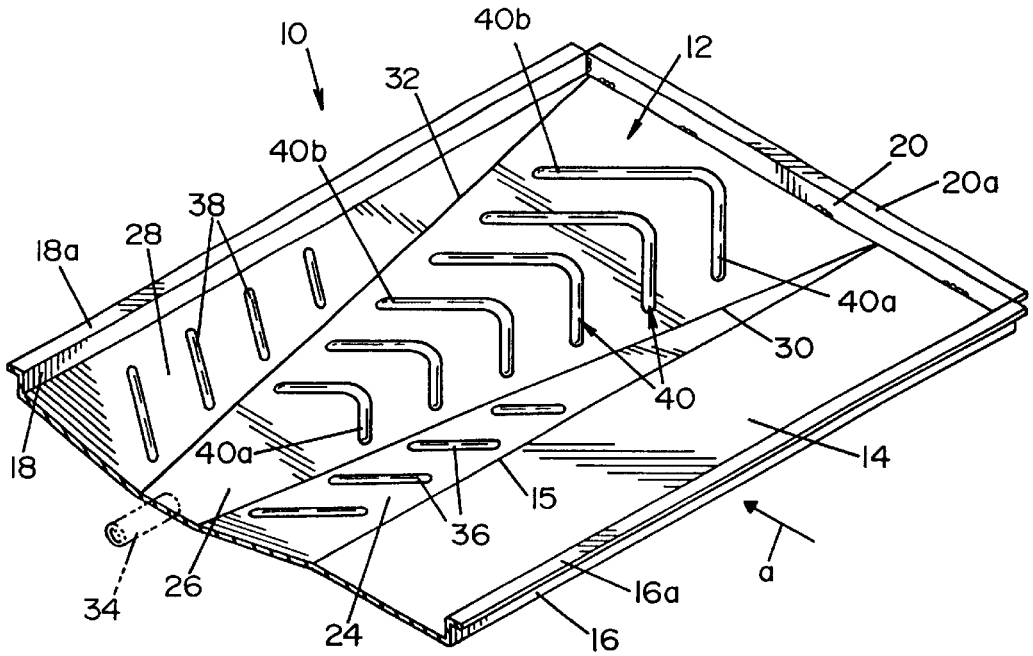
FIG. 1 is a perspective view of a condensate drain pan in accordance with the present invention.

Referring now in greater detail to the drawings wherein the showings are for the purpose of illustrating a preferred embodiment of the invention only and not for the purpose of limiting the invention, a condensate drain pan 10 in accordance with the invention comprises a compound-sloped floor surface 12 and a laterally adjacent flat floor surface 14 bounded by an upwardly extending peripheral wall defined by a front wall 16, a back wall 18 and opposite side walls 20 and 22. Flat floor surface 14 is located on the upstream side of airflow a Each of the foregoing walls has an upper end terminating in a corresponding outwardly extending flange respectively designated 16*a*, 18*a*, 20*a*, and 22*a*. Compound-sloped floor surface 12 includes three faces 24, 26, and 28, each of which is generally triangular in peripheral contour. Face 24 slopes downwardly and inwardly from the inner edge 15 of floor surface 14, face 26 slopes downwardly from side wall 20 to side wall 22, and face 28 slopes downwardly and inwardly from back wall 18. All three faces extend between side walls 20 and 22. Face 24 intersects with face 26 to provide a crease 30 therebetween, and face 28 intersects with face 26 to provide a crease 32 therebetween. Creases 30 and 32 converge in the direction from side wall 20 toward side wall 22 and the latter is provided with a drain or discharge tube 34 opening therethrough between the points of intersection of creases 30 and 32 with wall 22. Inner edge 15 of floor surface 14 and back wall 18 respectively define front and back edges of floor surface 12, and walls 20 and 22 define opposite side edges of floor surface 12.

Figure 2:
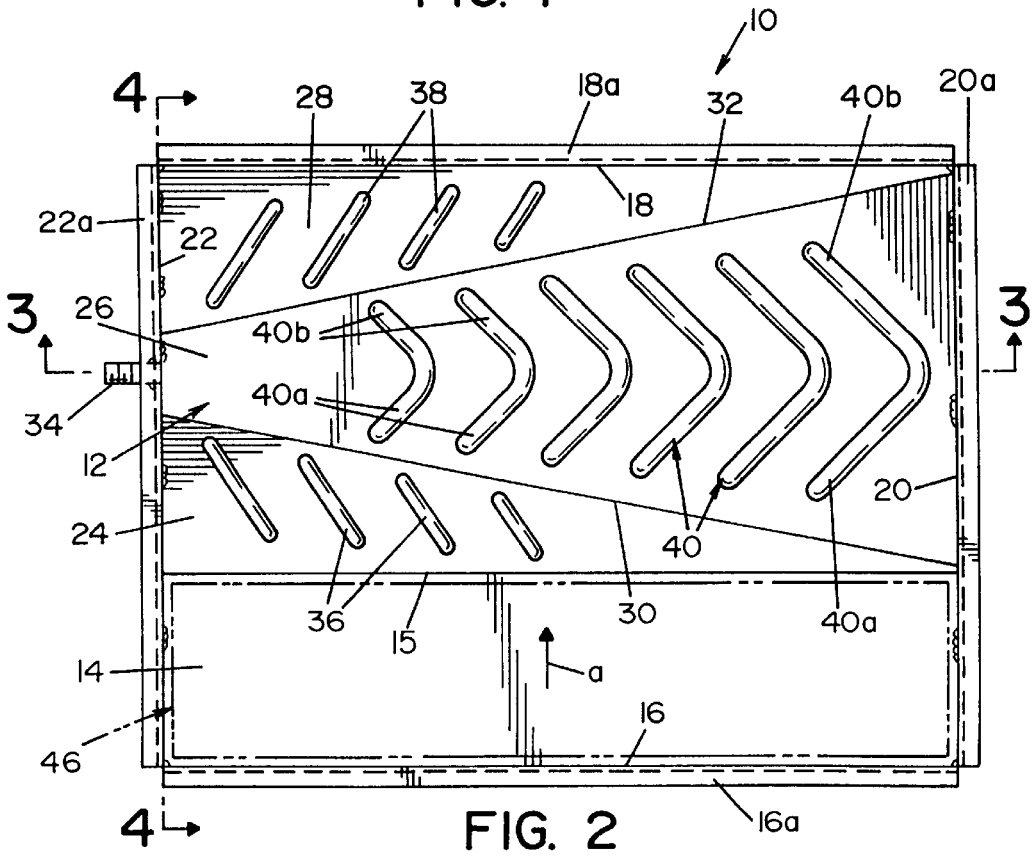
FIG. 2 is a plan view of the condensate drain pan.

The arrangement of sloped faces 24, 26, and 28 within condensate drain pan 10 provides a positive continuous slope which facilitates, promotes, and accelerates the flow and thus the removal of condensate from the associated air handling unit. Preferably, sloped face 24 is provided with upwardly projecting straight ribs or embossments 36 between inner edge 15 of surface 14 and crease 30, which are inclined relative to crease 30 so as to promote flow of condensate on face 24 toward crease 30 and drain tube 34. Embossments 36 are inclined relative to crease 30 so as to promote the flow of condensate on face 24 toward crease 30 and discharge tube 34. Similarly, sloped face 28 is provided with embossments 38 between wall 18 and crease 32 and which are inclined relative to crease 32 so as to promote the flow of condensate on face 28 toward crease 32 and discharge tube 34. Furthermore, sloped face 26 preferably is provided with upwardly projecting V or chevron shaped embossments 40 which have legs 40*a* and 40*b* diverging in the direction from side wall 20 toward side wall 22 and inclined relative to creases 30 and 32, respectively, to promote the flow of condensate on face 26 toward the corresponding crease and discharge tube 34. As will be appreciated from FIG. 2, the arrangement of chevron embossments affects and enhances the cascading movement of the condensate across sloped face 26. In this respect, the distal ends of legs 40*a* and 40*b* of the rightmost chevron embossment are further away from creases 30 and 32 than the distal ends of the leftmost chevron embossment, and the spacing of the distal ends from the creases progressively decreases in the direction from wall 20 toward wall 22. The aforementioned arrangement enhances the channeling effect of the condensate toward discharge tube 34.

Figure 3:
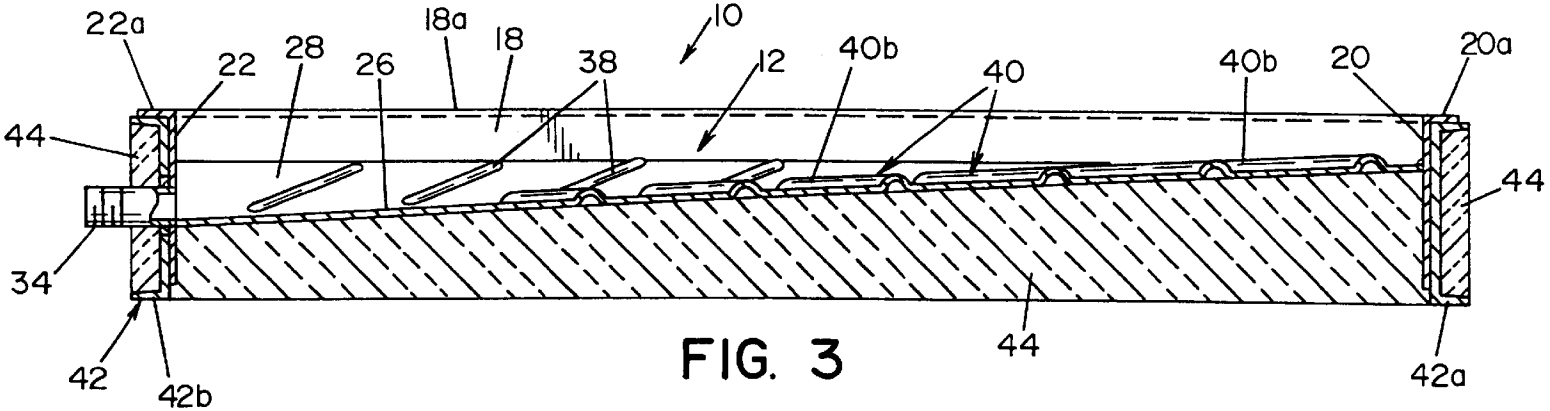
FIG. 3 is a sectional elevation view of the condensate drain pan taken along line 3—3 in FIG. 2; and, FIG. 4 is a sectional elevation view of the condensate drain pan taken along line 4—4 in FIG. 2.

As will be appreciated from FIG. 3, the drain pan can be supported in a frame 42 constructed of outwardly open channel members extending about the periphery of pan 10 as defined by walls 16, 18, 20, and 22 thereof. Sides 42*a* and 42*b* of frame 42 are shown, respectively, outwardly adjacent walls 20 and 22 and underlying flanges 20*a* and 22*a* thereof to support the pan, and it will be appreciated that similar frame sides are associated with pan walls 16 and 18.

Preferably, a suitable insulating material 44 is provided about the outer periphery of frame 42 and about the inner periphery thereof beneath floor surfaces 12 and 14 to minimize temperature loss through the pan.

Figure 4:
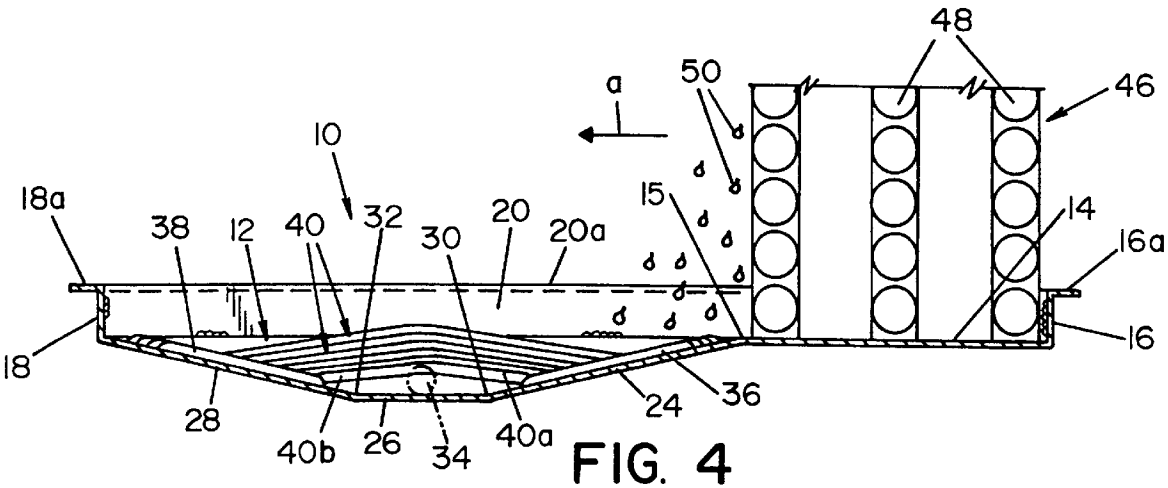

As shown in FIG. 4, floor surface 14 of condensate drain pan 10 underlies moisture condensing coil section 46 of an air handling unit when the pan is in its installed position. The moisture condensing coil section 46 includes coils 48 which generate condensate in the form of droplets 50 which are discharged from the coils 48 so as to drop onto floor surface 12 which, by the structure and configuration as described, condensate drain pan 10 channels the discharged condensate away from the air handling unit and accelerates the flow thereof to and through condensate drain pan discharge tube 34. More particularly, condensate discharged from the coils 48 will contact the surfaces of sloped faces 24, 26, and 28 and be directed thereby and by embossments 36, 38, and 40 to the creases 30 and 32. Once the condensate is channeled into creases 30 and 32, the condensate will flow therealong and, subsequently, out through the drain tube. The sloped floor surface 12 accelerates the drainage and removal of the condensate. The configuration of condensate drain pan 10 provides sufficient capacity to handle a varying amount of condensate discharge without impeding or trapping the condensate which eliminates the problem of standing water in the pan. As discussed previously, standing water is conducive to microbial growth.

While considerable emphasis has been placed herein on the structure of the preferred embodiment and on the interrelationships between the parts thereof, it will be appreciated that many modifications and alterations can be made in the embodiment herein illustrated and described without departing from the principles of the invention. Such modifications and alterations will occur to others upon the reading and understanding of the specification. It is intended to include all modifications insofar as they come within the scope of the appended claims or the equivalents thereof. Accordingly, it is to be distinctly understood that the foregoing descriptive matter is to be interpreted merely as illustrative of the present invention, and not as a limitation.

Having thus described the invention, it is claimed:

1. A condensate drain pan comprising a compound-sloped floor surface having spaced apart pairs of opposite edges, at least one high point adjacent one edge of one of said pairs of opposite edges, at least one low point adjacent the other edge of said one of said pairs of opposite edges, a plurality of intersecting sloped faces between said one edge and said other edge of said one pair of opposite edges, and a drain opening proximal to the low point of at least one of said sloped faces.

2. The condensate drain pan of claim 1, wherein at least one of said sloped faces includes a condensate directing embossment between said one edge and said other edge of said one pair of opposite edges.

3. The condensate drain pan of claim 1, wherein said drain opening is generally centrally between the other of said pairs of opposite edges.

4. The condensate drain pan of claim 1, wherein adjacent ones of said sloped faces intersect to form a crease extending between said one edge and said other edge of said one pair of opposed edges.

5. The condensate drain pan of claim 4, wherein said crease extends at an angle from said one edge toward said other edge.

6. The condensate drain pan of claim 5, wherein the end of said crease at said other edge is proximal to said drain opening.

7. The condensate drain pan of claim 1, wherein said plurality of sloped faces includes a first face generally centrally between the other of said pairs of opposite edges, and a pair of faces each between said first face and the adjacent one of the edges of said other of said pairs of edges.

8. The condensate drain pan of claim 7, wherein each of said first face and said pair of faces is generally triangular in peripheral contour.

9. The condensate drain pan of claim 8, wherein each of said first face and said pair of faces includes a plurality of condensate directing embossments between said one and said other edges of said one pair of opposite edges.

10. The condensate drain pan of claim 9, wherein said embossments on said pair of faces are straight and said embossments on said first face are V-shaped.

11. The condensate drain pan of claim 10, wherein said straight embossments on each face of said pair of faces are parallel to one another and at an angle to the adjacent one of the edges of said other of said pairs of edges.

12. The condensate drain pan of claim 11, wherein said V-shaped embossments are parallel to one another and include legs extending at an angle to the straight embossments in the adjacent one of the faces of said pair of faces.

13. The condensate drain pan of claim 12, wherein said plurality of straight embossments on each face of said pair of faces increase in length in the direction between said one and said other of said one pair of opposite edges.

14. The condensate drain pan of claim 13, wherein said legs of said V-shaped embossments decrease in length in the direction from said one edge toward said other edge of said one pair of opposite edges.

15. The condensate drain pan of claim 12, wherein said legs of said V-shaped embossments decrease in length in the direction from said one edge toward said other edge of said one pair of opposite edges.

16. A method of manufacturing a condensate drain pan comprising the steps of shaping a sheet of pan material to form a floor surface having pairs of opposite edges and a plurality of faces sloping downwardly from one edge of said one pair of said pairs of opposite edges and intersecting along creases therebetween, and forming a drain opening at the other edge of said one pair of opposite edges.

17. The method of claim 16, and forming a plurality of condensate directing embossments in said faces.

18. The method of claim 17, wherein said embossments include straight embossments at an angle to said other edge.

19. The method of claim 17, wherein said embossments include V-shaped embossments having legs at an angle to said other edge.

20. The method of claim 19, wherein said embossments include straight embossments at an angle to said other edge.

21. The method of claim 16, wherein said plurality of sloped faces includes a first face generally centrally between the other of said pairs of opposite edges, and a pair of faces each between said first face and the adjacent one of the edges of said other of said pairs of edges.

22. The method of claim 21, and forming a plurality of straight condensation directing embossments in each face of said pair of faces.

23. The method of claim 21, and forming a plurality of V-shaped condensation directing embossments in said first face.

24. The method of claim 23, and forming a plurality of straight condensation directing embossments in each face of said pair of faces.

* * * * *